United States Patent [19]

Matsubara

[11] 4,002,322

[45] Jan. 11, 1977

[54] INTERLOCKING HANDRAIL CONSTRUCTION FOR BALUSTRADES

[75] Inventor: Isamu Matsubara, Nyuzen, Japan

[73] Assignee: Yoshida Kogyo K.K., Tokyo, Japan

[22] Filed: Sept. 24, 1975

[21] Appl. No.: 616,146

[30] Foreign Application Priority Data

Oct. 2, 1974 Japan ..... 49-119582[U]

[52] U.S. Cl. ..... 256/65

[51] Int. Cl.[2] ..... E04H 17/14

[58] Field of Search ..... 256/59, 65–70, 256/13.1, 22, 19; 248/251, 226 D, 316 C

[56] References Cited

UNITED STATES PATENTS

| | | | |
|---|---|---|---|
| 968,908 | 8/1910 | Williams | 256/65 |
| 2,427,723 | 9/1947 | Hawkins et al. | 256/22 |
| 2,807,834 | 10/1957 | Blum | 248/251 |
| 3,071,350 | 1/1963 | Opie | 256/65 |
| 3,239,070 | 3/1966 | Clauson | 256/59 |
| 3,379,414 | 4/1968 | Thurnauer | 256/68 |
| 3,544,072 | 12/1970 | Thom | 256/59 |

*Primary Examiner*—Werner H. Schroeder
*Assistant Examiner*—Doris L. Troutman
*Attorney, Agent, or Firm*—Hill, Gross, Simpson, Van Santen, Steadman, Chiara & Simpson

[57] ABSTRACT

An interlocking construction for balustrades mounted on a parapet or like foundation. The construction includes a bracket mounted on a foundation and having at its top end an arm terminating in a first locking prong and a securing member connected at its one end to the bracket and having at the other end a second locking prong. A handrail is provided with a pair of spaced-apart locking means such as grooves or prongs each extending along the handrail. The first and second locking prongs engage the locking means to grip the handrail in place on the bracket arm and the bracket-mounted securing member.

7 Claims, 5 Drawing Figures

INTERLOCKING HANDRAIL CONSTRUCTION FOR BALUSTRADES

BACKGROUND OF THE INVENTION

1. Field of The Invention

This invention relates to a construction for interlocking or coupling handrails with brackets of a balustrade mounted on a parapet or the like.

2. Prior Art

Various prior art attempts have been known in the art of balustrades for interlocking handrails with brackets which are mounted on a barrier such as a parapet and which support thereon the handrail. One such attempt was to utilize screws for securing these balustrade components together. However, this prior art attempt involved time-consuming drilling operations to form screw-inserting holes in the handrail precisely in registry with the positions at which the brackets are to be located. This attempt was furthermore disadvantageous in that handrail-securing operation is relatively time-consuming and tedious, and the handrail and brackets held together by the screws are susceptible to internal stresses developed therein when subjected to deformation such as thermal expansion or contraction. Another prior art attempt was to secure these balustrade parts together by welding, but was also found disadvantageous due to its complicated assembling operation and poor appearance of the resulting balustrades.

SUMMARY OF THE INVENTION

With the above-noted drawbacks in mind, it is the principal object of the invention to provide a construction for interlocking or coupling handrails with brackets with greater ease.

Another object of the invention is to provide a construction of the type described which is relatively simple and inexpensive and yet ensures that the final balustrade structure is rigid.

Briefly stated, the present invention provides an interlocking construction for balustrades which comprises: a bracket mounted on a foundation and having at its top end an arm which terminates in a first locking prong; a securing member connected at one end to said bracket and having the other end formed into a second locking prong; and a handrail having a pair of spaced-apart locking means each extending along the length of the handrail, said first and second locking prongs engaging said locking means to grip said handrail in place on said arm and said securing member.

The above and other objects and advantages of the invention will become apparent as the description proceeds with reference to the accompanying drawings in which like reference numerals apply to like or corresponding parts throughout the several views.

DESCRIPTION OF THE PREFERRED EMBODIMENTS

Figure 1:
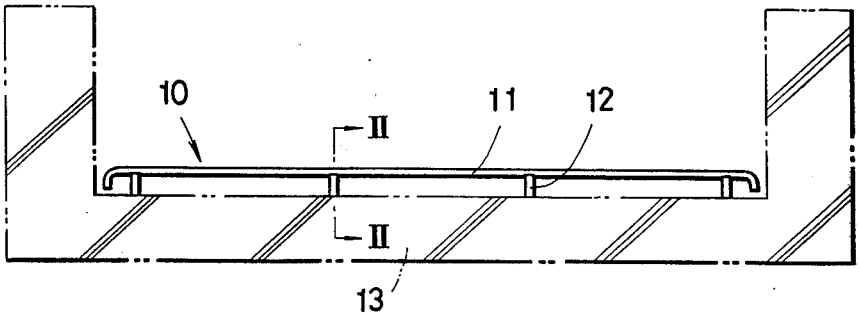
FIG. 1 is an elevational view of a balustrade assembled and mounted on a parapet.
Figure 2:
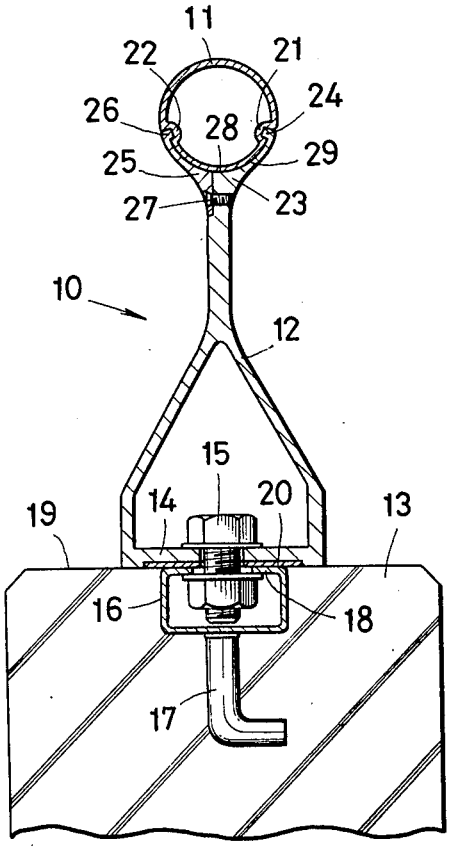
FIG. 2 is a transverse cross-sectional view taken along the line II—II of FIG. 1 and showing a construction according to the invention for interlocking a handrail with a bracket.

As shown in FIGS. 1 and 2, a balustrade generally designated 10 includes an elongated tubular handrail 11 made of a metal or a plastic material and supported on a plurality of brackets 12 equally spaced apart one from another along the length of the handrail 11. The brackets 12 are mounted on a foundation 13 such for example as a parapet which is in turn mounted on and serves to protect the edges of platforms, bridges, balconies and other structures as is well known in the art. In the embodiment shown in FIG. 2 each bracket 12 is disposed in upright position extending substantially at a right angle to a plane of the foundation later described and has at its bottom end a base plate 14 which is connected by a bolt 15 to a box 16 embedded in the foundation 13 and having an L-shaped anchor 17 which extends downwardly from the underside of the box 16 and is embedded also in the foundation 13, whereby the bracket 12 is held securely in position on the foundation 13. The embedded box 16 has its top face 18 lying substantially flush with a horizontal upper surface 19 of the foundation 13. Interposed between the bracket base plate 14 and the embedded box 16 is a waterproof plate 20 through which the bolt 15 passes and which prevents the intrusion of water into the region where the bolt 15 interconnects the base plate 14 with the box 16.

Figure 4:
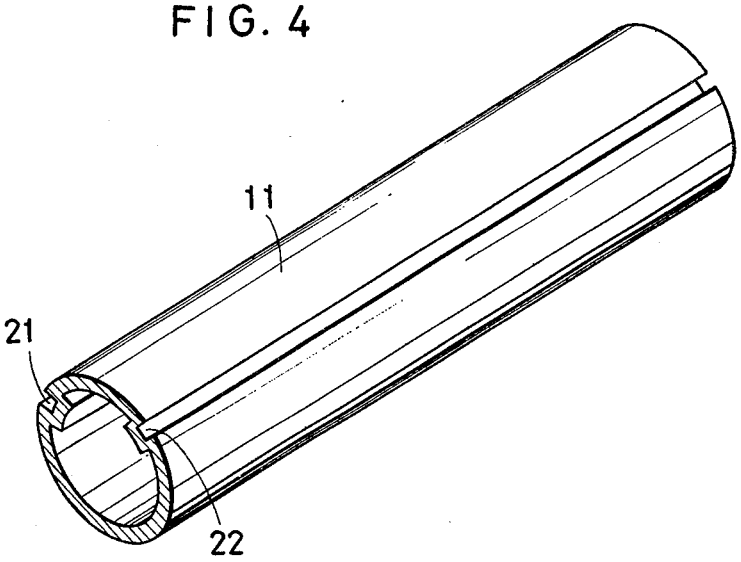
FIG. 4 is an enlarged, inverted perspective view of the handrail.

According to an important aspect of the invention, the tubular handrail 11 is provided with a pair of locking means such as grooves or recesses 21 and 22 extending along and throughout the entire length of the handrail 11 as best shown in FIG. 4 and spaced circumferentially from each other. The bracket 12 at its top end has an arm 23 terminating in a first locking prong 24 adapted for locking engagement with the groove 21. There is also a securing member 25 having at one end a second locking prong 26 adapted also for locking engagement with the groove 22. The other end of the securing member 25 is apertured to pass therethrough a screw 27 which connects the securing member 25 tightly to the bracket 12. When the arm 23 and the securing member 25 are connected together, they provide a handrail receiving surface 28 curved to conform with the peripheral surface 29 of the handrail 11 which extends between the grooves 21 and 22. The first and second locking prongs 24 and 26 are spaced circumferentially from each other and located to correspond in position to the grooves 21 and 22. With this structure, the handrail 11 is mounted securely on the arm 12 and the securing member 25, so that the peripheral surface 29 of the handrail 11 is seated in complemental relation to the handrail receiving surface 28 with the grooves 21 and 22 receiving therein the first and second locking prongs 24 and 26, respectively.

Figure 3:
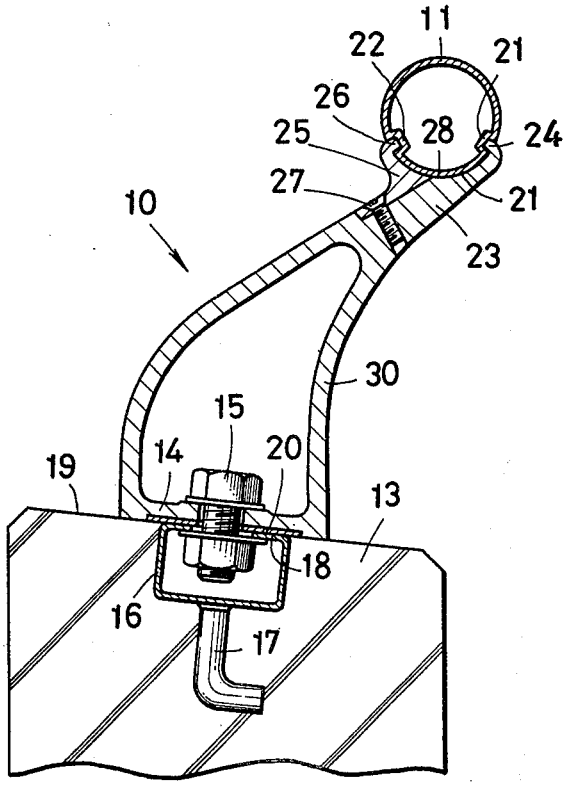
FIG. 3 is a view similar to FIG. 1, but showing a modified form of the bracket.

According to a modified form of the bracket 30 shown in FIG. 3, the handrail 11 may be displaced in either direction relative to the vertical axis of the balustrade 10. The foundation 13 has its upper surface 19 slanted slightly and supports thereon a bracket 30 which is deformed out of registry with the vertical axis of the blustrade 10.

Figure 5:
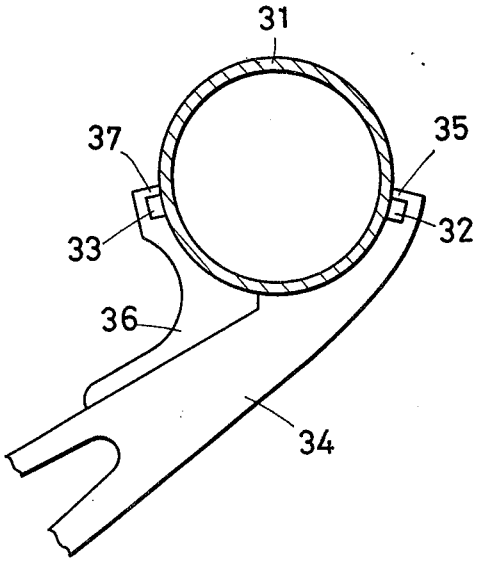
FIG. 5 is a fragmentary cross-sectional view showing another embodiment of the invention.

As shown in FIG. 5, as contrasted with the first embodiment, a handrail 31 has first and second locking means such as a pair of prongs 32 and 33 which may extend along and throughout the length of the handrail 31 and are spaced circumferentially apart from each other in a manner similar to those of the first-mentioned embodiment. There is formed in the top of a bracket 34 a locking prong 35 with which the first locking prong 32 is adapted to engage. A securing member 36 mounted on the bracket 34 has at its free end a locking prong 37 which is adapted to engage the second locking prong 33. When these balustrade members are assembled, the handrail 31 is locked in place on the bracket 34 and the securing member 36 with the first and second locking prongs 32 and 33 engaged with the locking prongs 35 and 37, respectively. As shown in FIG. 5, the elongated grooves 21 and 22 formed in the handrail 11 according to the embodiment of FIG. 2, and the elongated locking prongs 32 and 33 formed on the handrail 31 according to the embodiment of FIG. 5 may be interrupted longitudinally and located only at the position at which the brackets are mounted on the foundation 13.

The securing members 25 and 36 may be secured to the brackets 12 and 30 by welding or adhesive bonding, and the handrail may have another cross-section, such as a rectangular or elliptic shape for example, for mating with a correspondingly contoured handrail receiving surface provided by a mated bracket and securing member.

Advantageously, longitudinal deformation of the handrail by thermal expansion or contraction inhibits the development therein of internal stresses because the handrail 11 mounted on the bracket 12 and the securing member 25 is allowed to expand longitudinally when subjected to heat. The grooves 21, 22 or locking prongs 32, 33 of the handrail can be formed simultaneously with the extrusion of the handrail with the results that the final balustrade product is relatively inexpensive and further that the handrail can be installed speedily. Furthermore, since the securing member 25 is movable longitudinally of and along the handrail 11, its screw-inserting aperture can be readily registered with the tapped hole in the bracket 12.

What is claimed is:

1. An interlocking construction for balustrades to be secured to a foundation, which comprises:

a. a bracket having means at one end adapted to be mounted on the foundation, said bracket having an arm at its other end, said arm terminating in a first locking prong;

b. a securing member connected at one end to said bracket and having its other end formed into a second locking prong;

c. A handrail having a pair of peripherally spaced-apart locking means each extending along the length of the handrail, said first and second locking prongs engaging said locking means to grip said handrail in place on said arm and said securing member; and d. said arm and said securing member jointly providing a continuous surface conforming to the portion of the peripheral surface of said handrail lying between said pair of locking means, and supporting said handrail thereon.

2. A device according to claim 1, said continuous surface being concave.

3. A device according to claim 1, said bracket and said securing member jointly having a Y-shaped cross section, one arm of the Y-shape being said securing member.

4. A device according to claim 1, said first locking prong being integral with said bracket and hence fixed with respect to the foundation.

5. A device according to claim 1, said one end of said securing member being inset into said bracket such that the external surfaces of said securing member and said bracket are continuous.

6. An interlocking construction as defined in claim 1, wherein said locking means are located only at the position at which said bracket is mounted on said foundation.

7. An interlocking construction as defined in claim 1, wherein said locking means are radially projecting prongs.

* * * * *